United States Patent [19]

Siggen et al.

[11] 4,338,882

[45] Jul. 13, 1982

[54] PLASTICIZER INSTALLATION FOR THE TREATMENT OF A ROPE OF FIBRES

[75] Inventors: Guy Siggen, Juriens; Michel Berney, Bavois, both of Switzerland

[73] Assignee: Baumgartner Papiers S.A., Switzerland

[21] Appl. No.: 191,419

[22] Filed: Sep. 29, 1980

[30] Foreign Application Priority Data

Jan. 30, 1980 [CH] Switzerland ..... 737/80

[51] Int. Cl.[3] ..... B05B 5/02

[52] U.S. Cl. ..... 118/674; 118/630

[58] Field of Search ..... 118/630, 674

[56] References Cited

U.S. PATENT DOCUMENTS 3,442,688 5/1969 Pettigrew ..... 118/630

3,817,211 6/1974 Brown et al. ..... 118/630

*Primary Examiner*—Bernard D. Pianalto

*Attorney, Agent, or Firm*—Kane, Dalsimer, Kane, Sullivan and Kurucz

[57] ABSTRACT

A plasticizer installation comprises a chamber through which a fibre rope passes in front of a spray device comprising a turbine, connected to a source of high voltage and located between a truly rectilinear path and the actual rope path, which paths define a trapezium. The plasticizer mist carried along by the rope is recovered in a decompression booth. The supply of plasticizer is controlled according to the weight of an intermediate vat also receiving the flow from the booth.

The plasticized rope of fibres is intended to be used in the production of cigarette filters.

6 Claims, 1 Drawing Figure

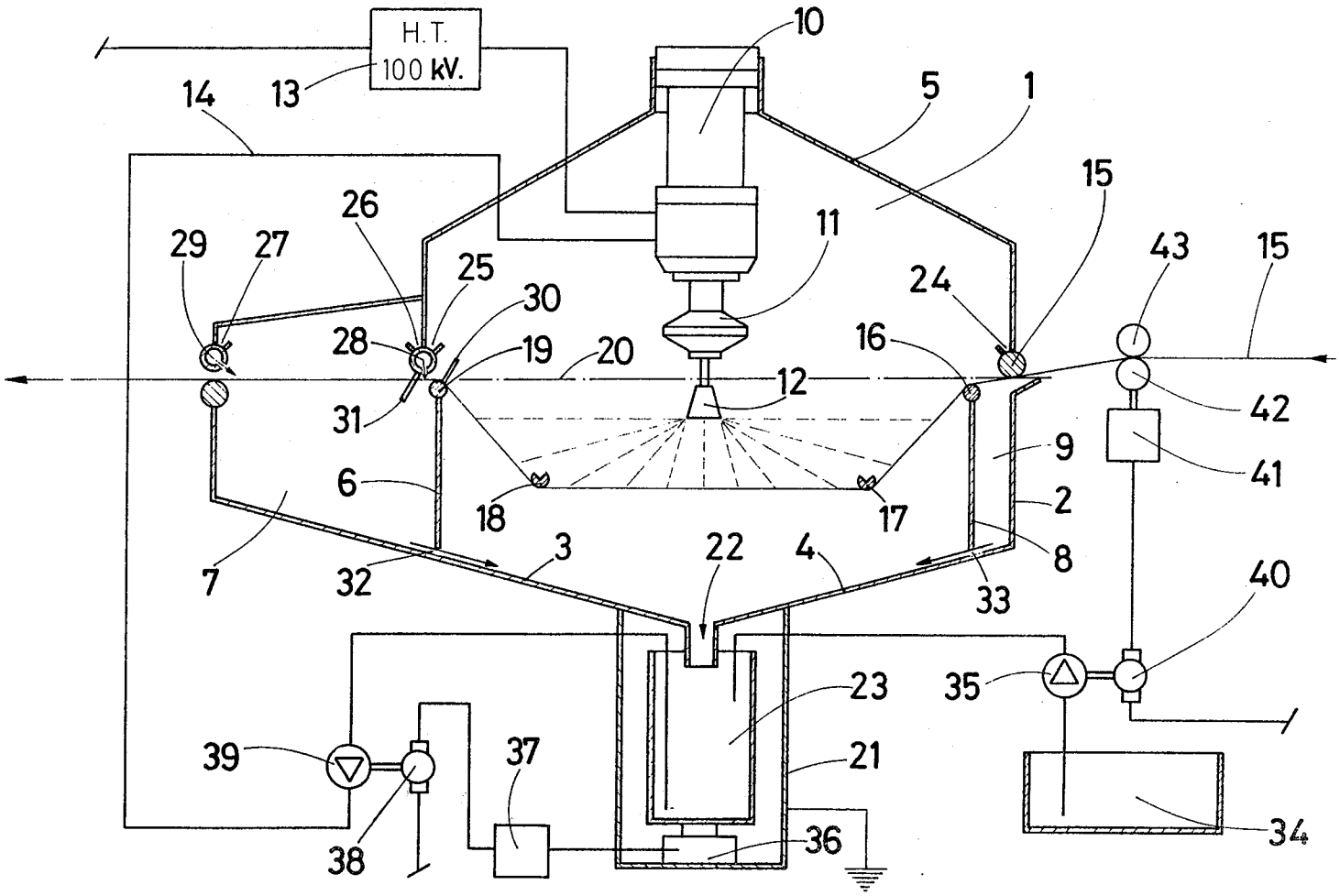
H.T.
100 kV.

PLASTICIZER INSTALLATION FOR THE TREATMENT OF A ROPE OF FIBRES

The present invention relates to a plasticizer installation for the treatment of a rope of fibres intended for the manufacture of cigarette filters, the installation comprising a chamber through which the rope, spread out in sheet form, is moved continuously past a device for spraying liquid plasticizer.

Plasticizing cellulose acetate fibres intended for the manufacture of cigarette filters is necessary in order to obtain bonding of the fibres so as to give sufficient cohension and strength of filter rods. The addition to the fibres of a plasticizer material in sufficient quantity makes it possible to obtain the desired bond.

In known installations, rotary discs, in the form of a cylindrical cup comprising a perforated edge, or rotary brushes, have been used hitherto as the spray means. However, these two arrangements have drawbacks and limits which, if they were acceptable for high denier fibres, are no longer acceptable for modern lower denier fibres. In fact, it will be found that with such known arrangements, it is not possible to achieve a sufficient degree of homogeneity of distribution of the plasticizer, since the size of the droplets is too great, no means being provided for controlling this droplet size. A poor distribution of the plasticizer or droplets which are too large cause local concentrations of plasticizer which with fine fibres cause holes in the rope due to the flow of excess plasticizer. However, droplets which are too large have poor diffusion through the rope, which also reduces the homogeneity of disperson throughout the thickness of the rope. Moreover, the proportion of plasticizer effectively received by the rope relative to the quantity of plasticizer sprayed is relatively low.

The object of the present invention is to ensure a homogeneous and more efficient dispersion of very fine droplets of plasticizer, which can be controlled easily.

According to the present invention there is provided a plasticizer installation for the treatment of a rope of fibres intended for the manufacture of cigarette filters, the installation comprising a chamber through which the rope, spread out in the form of a sheet, is moved continuously in front of a device for spraying liquid plasticizer, which device comprises a turbine and a spray head connected to a source of D.C. voltage and located above the path of the rope, the chamber being connected to earth and housing means for guiding the rope, which means are arranged such that the rope is deflected below a truly rectilinear path, and the spray head being located below said truly rectilinear path.

The use of a spray device comprising a compressed air turbine operating at very high speed, of the order of 60,000 r.p.m., makes it possible to obtain a dispersion of the plasticizer in the form of very fine droplets forming a mist. Since the latter is also charged electrically at a high voltage with respect to the rope, it is deposited uniformly on the rope and on the walls of the chamber which are kept at an appropriate potential, for example zero.

Owing to the guidance of the rope, which follows a dished path and to the position of the spray head relative to this path, i.e. as close as possible to the rope, a large proportion of plasticizer is deposited on the rope.

The size of the droplets depends on the electrostatic force and on the speed of the turbine, which are two parameters which can be controlled and modified easily.

BRIEF AND DETAILED DESCRIPTION OF THE FIGURE

The accompanying diagrammatic drawing shows, by way of example, one embodiment of an installation according to the invention in sectional longitudinal elevation.

The installation comprises a plasticizing chamber constituted by a stationary lower part 2 in the shape of a tank of rectangular section, whereof the bottom comprises two walls 3 and 4 and by an upper part 5, substantially in the shape of a bell jar, whereof the edges are aligned with the edges of the lower part 2. The upper part 5 can be separated from the lower part 2, either by a rectilinear movement or by rotation. It may, for example, be pivoted by a hinge to the edge of the lower part 2. The chamber is sub-divided by a wall 6 into a primary compartment 1 and a secondary compartment 7 located at the outlet of the primary compartment. A second inner wall 8, identical to the wall 6, also defines with a wall of the lower part 2 a recovery chamber 9 close to the inlet of the chamber. Fixed to the top of the upper part 5 through the intermediary of an insulating support 10 is a compressed air turbine 11 operating at very high speed (60,000 r.p.m. for example) associated with a distribution head 12. These define a spray device known per se, and sold by the SAMES company of Grenoble for example.

The turbine 11 is connected to a 100 kV source of D.C. voltage 13, and to a pipe 14 supplying plasticizer.

The rope 15, upon leaving a spreading and treatment station, enters the chamber 1 by sliding along the rounded edge 15, then it follows a trapezoidal path imparted by the upper edge 16 of the wall 8, two transverse bars 17 and 18 and an edge 19 of the wall 6. It is drawn continuously through the chamber by entrainment means which are not shown. The path of the rope in the chamber thus passes below the rectilinear path 20 used in chambers of the prior art. In the operating position, the distribution head 12 is also located substantially below this path 20, inside the trapezium, at a distance which is as short as possible from the rope. This distance may be less than 10 cm.

In its lower part, the chamber is connected to an enclosure 21 by which it is connected to earth. The chamber, as well as the guides for the rope are metallic. The inclined base 3, 4 has an aperture 22 opening into a vat 23. Above the path of the rope 15, the edges of the upper part 5 are provided with two gutters 24 and 25 intended to prevent the plasticizer flowing on the walls of the upper part from draining onto the rope. The same is true for the secondary compartment 7, of which the upper part is provided with two gutters 26 and 27.

The edges of the upper part 5 and the secondary compartment 7 transverse with respect to the direction of movement of the rope 15, are provided with perforated tubes 28 and 29 connected to a source of compressed air for the formation of a curtain of compressed air at the point where the rope leaves the chamber and the compartment 7. These curtains of compressed air are intended to retain the mist of plasticizer carried along by the rope which moves at a relatively high speed. Baffles 30 and 31 are also provided at the outlet of the primary compartment 1, on each side of the rope, which baffles are also intended to retain the plasticizer mist. The secondary compartment 7 and the recovery chamber 9 are also connected to the central part of the chamber by respective passages 32 and 33 provided at the bottom of the walls 6 and 8.

The plasticizer is supplied from a primary vat 34, constituting a reservoir. The plasticizer is, for example, triethylene glycoldiacetate or triacetine or dimethylphthalate. The plasticizer in the primary vat 34 is pumped by means of a pump 35 into the secondary vat 23 which constitutes a transit and regulating vat. This secondary vat 23 is mounted on a weight measuring device 36, for example a piezoelectric strain gauge, which continuously measures the weight of the vat 23, i.e. the weight of the plasticizer contained in this vat. The strain gauge 36 is connected to a control circuit 37 controlling the motor 38 of a pump 39 located in the circuit 14 for supplying power to the turbine.

The motor 40 of the pump 35 is also controlled by a control circuit 41 associated with a speed monitoring device 42 continuously measuring the speed of travel of the rope 15. This device 42 is constituted, for example, by a tachometer associated with a pair of rollers 43 between which the rope 15 is entrained.

Consequently, the pump 35 introduces a quantity of plasticizer proportional to the speed of travel of the rope 15, into the secondary vat 23. On the other hand, the quantity of plasticizer absorbed by the rope is equal to the difference between the quantity introduced by the pump 35 and the quantity recovered at 22. The control circuit 37 tends to keep the weight of plasticizer contained in the secondary vat 23 constant. One thus obtains a regulation of the weight of plasticizer sprayed onto the rope, depending on the speed of travel of the rope. In effect, if, for example, the speed of the rope increases, the output of the pump 35 increases and the quantity, namely the weight of plasticizer in the vat 23 in turn increases, which causes an increase in the output of the pump 39. It is important to note that the weight and not the volume is controlled, which makes it possible to eliminate the influence of the emulsion in air.

On the other hand, it will be noted that all the parameters of the installation can be controlled and modified easily with a view to achieving an optimum result.

The rope could be deflected along another trajectory satisfying the same conditions, but the possibilities are limited by the low resistance to traction of the rope. However, contrary to what one might believe, a deflection such as that shown in the drawing is quite acceptable.

Numerous variations are possible, without departing from the scope of the claims, in particular as regards the shape of the chamber, the means for guiding the rope and the means for retaining and recycling the plasticizer.

What is claimed is:

1. A plasticizer installation for the treatment of a rope of fibres intended for the manufacture of cigarette filters, the installation comprising a chamber through which the rope, spread out in the form of a sheet, is moved continuously in front of a device for spraying liquid plasticizer, which device comprises a turbine and a spray head connected to a source of D.C. voltage and located above the path of the rope, the chamber being connected to earth and housing means for guiding the rope, which means are arranged such that the rope is deflected below a truly rectilinear path, and the spray head being located below said truly rectilinear path.

2. An installation according to claim 1, in which the guide means are constituted by two bars deflecting the rope such that it forms a trapezium with the truly rectilinear path constituting the upper side thereof and the spray head being located below said upper side of the trapezium, at a distance from the lower side of the trapezium less than 10 cm.

3. An installation according to claim 1, in which the chamber is constituted by a stationary lower part and a movable upper part supporting the spray device.

4. An installation according to claim 1, in which the chamber is sub-divided into a primary compartment, in which the spraying takes place and a secondary decompression compartment, located at the outlet of the primary compartment, for retaining and recovering the plasticizer.

5. An installation according to claim 4, in which, at the outlet of the primary compartment and at the outlet of the secondary compartment above the path of the rope, there is provided a perforated tubular edge connected to a source of compressed air to provide a curtain of air intended to retain the plasticizer mist.

6. An installation according to claim 1 comprising a primary vat constituting a plasticizer reservoir, a speed monitoring device for the rope associated with the drive of a pump intended to pump the plasticizer from the primary vat, and a secondary vat located below a dram orifice of the chamber, receiving the plasticizer pumped from the primary vat and mounted on a device for measuring the weight of the secondary vat and associated with a device for controlling a pump connecting the secondary vat to the spray device.

* * * * *